US009046112B2

(12) United States Patent
Finidori et al.

(10) Patent No.: US 9,046,112 B2
(45) Date of Patent: Jun. 2, 2015

(54) MECHANICAL COOLANT PUMP

(75) Inventors: Laurent Finidori, Bertrange (FR); Jean-Michel Durand, Metz (FR); Arnaud Fournier, Yutz (FR)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 595 days.

(21) Appl. No.: 13/498,689

(22) PCT Filed: May 5, 2010

(86) PCT No.: PCT/EP2010/056104

§ 371 (c)(1),
(2), (4) Date: Jun. 4, 2012

(87) PCT Pub. No.: WO2011/042219

PCT Pub. Date: Apr. 14, 2011

(65) Prior Publication Data

US 2012/0243974 A1 Sep. 27, 2012

(30) Foreign Application Priority Data

Oct. 6, 2009 (EP) ..... 09172318

(51) Int. Cl.

| | |
|---|---|
| ***F04D 29/46*** | (2006.01) |
| ***F01P 7/14*** | (2006.01) |
| ***F04D 29/22*** | (2006.01) |
| ***F04D 29/62*** | (2006.01) |

(52) U.S. Cl.

CPC ..... *F04D 29/466* (2013.01); *F01P 7/14* (2013.01); *F04D 29/2216* (2013.01); *F04D 29/628* (2013.01)

(58) Field of Classification Search

CPC . F04D 29/466; F04D 29/2216; F04D 29/628; F01P 7/14

USPC ..... 415/148, 164, 165, 206; 416/185, 416/186 R, 187

See application file for complete search history.

(56) References Cited

U.S. PATENT DOCUMENTS

| | | | | |
|---|---|---|---|---|
| 1,020,699 | A * | 3/1912 | Kieser | 415/106 |
| 5,064,344 | A * | 11/1991 | Kassel et al. | 415/224.5 |
| 5,385,442 | A | 1/1995 | Lehe et al. | |
| 6,371,724 | B2 * | 4/2002 | Nagaoka et al. | 415/208.3 |

(Continued)

FOREIGN PATENT DOCUMENTS

| | | |
|---|---|---|
| CN | 1732336 A | 2/2006 |
| CN | 101253314 | 8/2008 |

(Continued)

OTHER PUBLICATIONS

Yoshikawa, Guide vanes for water wheel or pump, Oct. 25, 1979, JP 54-137532A abstract.*

(Continued)

*Primary Examiner* — Liam McDowell
(74) *Attorney, Agent, or Firm* — Norman B. Thot

(57) ABSTRACT

A mechanical coolant pump for an internal combustion engine includes a pump rotor wheel comprising a blocking ring and rotor blades. The rotor blades are configured to pump a coolant radially outwardly. Variable pump stator blades are pivotably supported by a static blade holding ring at a first axial blade end. The variable pump stator blades are arranged radially outwardly of the pump rotor wheel. The blocking ring is arranged to partially overlap a second axial blade end.

7 Claims, 3 Drawing Sheets

(56) References Cited

U.S. PATENT DOCUMENTS

| | | | | |
|---|---|---|---|---|
| 8,240,976 | B1 * | 8/2012 | Kamio | 415/1 |
| 2005/0106040 | A1 | 5/2005 | Repple et al. | |
| 2008/0216775 | A1 | 9/2008 | Repple et al. | |
| 2009/0214330 | A1 | 8/2009 | Espasa et al. | |

FOREIGN PATENT DOCUMENTS

| | | | | |
|---|---|---|---|---|
| CN | 101532376 | A | | 9/2009 |
| FR | 921 711 | A | | 5/1947 |
| FR | 2 698 667 | A1 | | 6/1994 |
| JP | 54-137532 | A | * | 10/1979 |
| JP | 54-144527 | A | * | 11/1979 |
| JP | 62-197698 | A | | 9/1987 |
| JP | 4-311698 | A | | 11/1992 |
| JP | 2006-512524 | A | | 4/2006 |
| WO | WO 2004/059142 | A1 | | 7/2004 |
| WO | WO 2007/025375 | A2 | | 3/2007 |

OTHER PUBLICATIONS

Takahashi, Guide vane protection device in water wheel guide vane control mechanism, Nov. 10, 1979, JP 54-144527A abstract.*

* cited by examiner

MECHANICAL COOLANT PUMP

CROSS REFERENCE TO PRIOR APPLICATIONS

This application is a U.S. National Phase application under 35 U.S.C. §371 of International Application No. PCT/EP2010/056104, filed on May 5, 2010 and which claims benefit to European Patent Application No. 09172318.9, filed on Oct. 6, 2009. The International Application was published in English on Apr. 14, 2011 as WO 2011/042219 A1 under PCT Article 21(2).

FIELD

The present invention provides an adjustable mechanical coolant pump for an internal combustion engine.

BACKGROUND

Mechanical coolant pumps of the prior art are described in WO 2004 059142 A1. These pumps comprise a pump rotor wheel and a housing which supports numerous variable pump stator blades. The pump is assembled by first mounting the variable pump stator blades in respective pivot openings in the housing. After the pump rotor wheel has been mounted, the pump is transferred to a combustion engine block to be installed at the engine block. During the transfer, the stator blades are not secured against loosening so that they can drop out.

SUMMARY

An aspect of the present invention is to provide a mechanical coolant pump with an improved mounting procedure.

In an embodiment, the present invention provides a mechanical coolant pump for an internal combustion engine which includes a pump rotor wheel comprising a blocking ring and rotor blades. The rotor blades are configured to pump a coolant radially outwardly. Variable pump stator blades are pivotably supported by a static blade holding ring at a first axial blade end. The variable pump stator blades are arranged radially outwardly of the pump rotor wheel. The blocking ring is arranged to partially overlap a second axial blade end.

BRIEF DESCRIPTION OF THE DRAWINGS

The present invention is described in greater detail below on the basis of embodiments and of the drawings in which.

DETAILED DESCRIPTION

Figure 1:
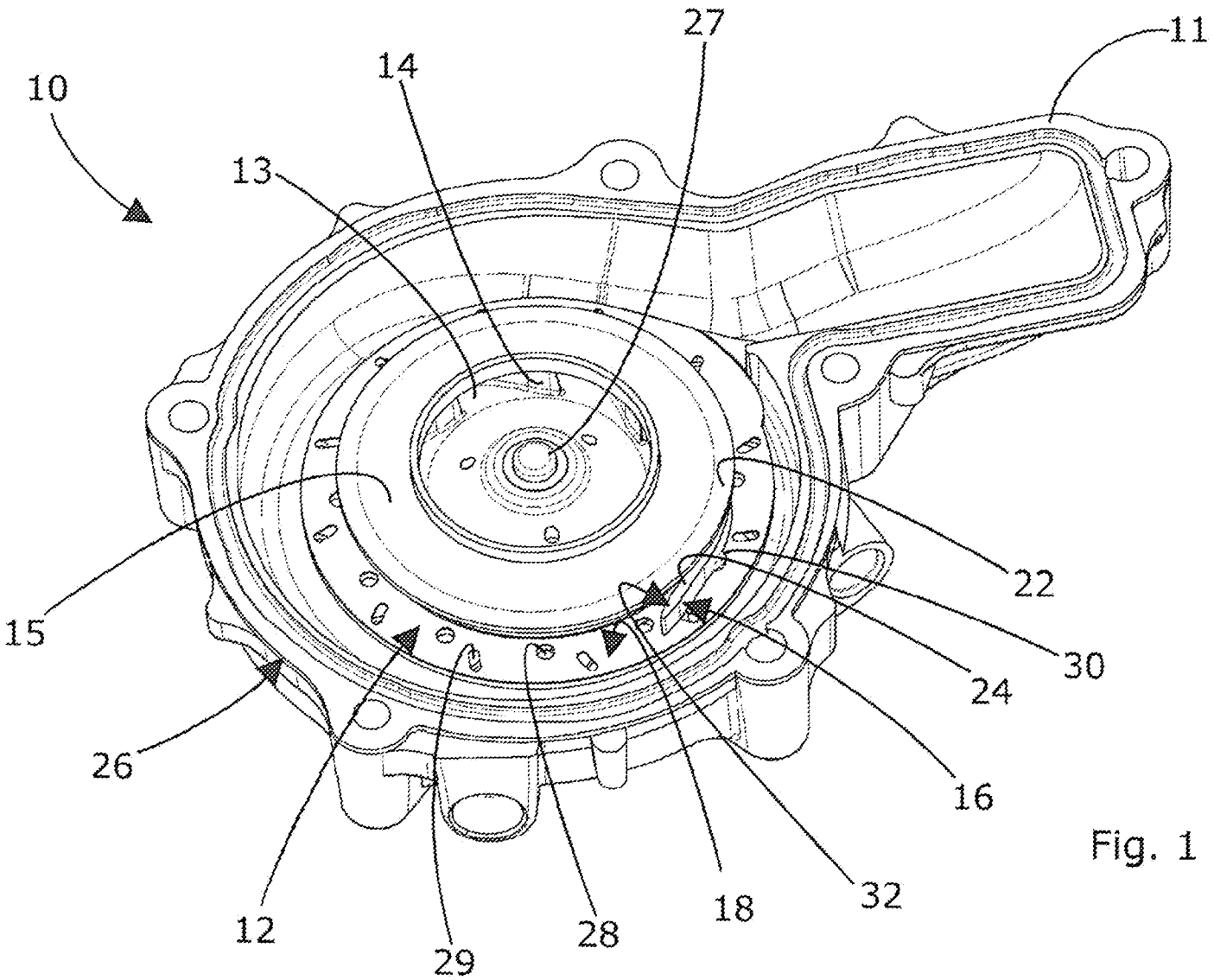
FIG. 1 shows a perspective view of a mechanical coolant pump.
Figure 2:
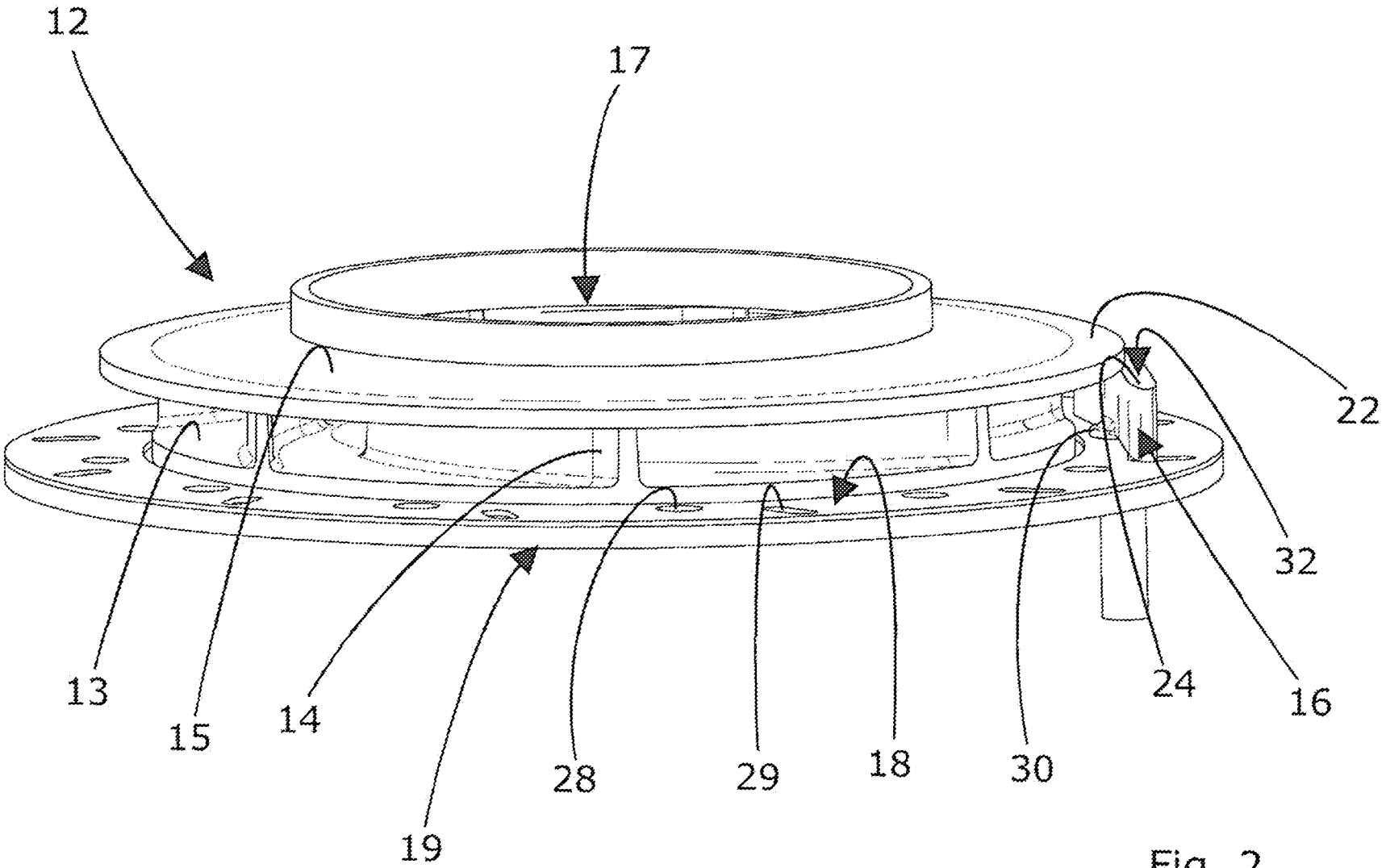
FIG. 2 shows a perspective view of the pump rotor wheel, the blocking ring and the stator blades of FIG. 1.
Figure 3:
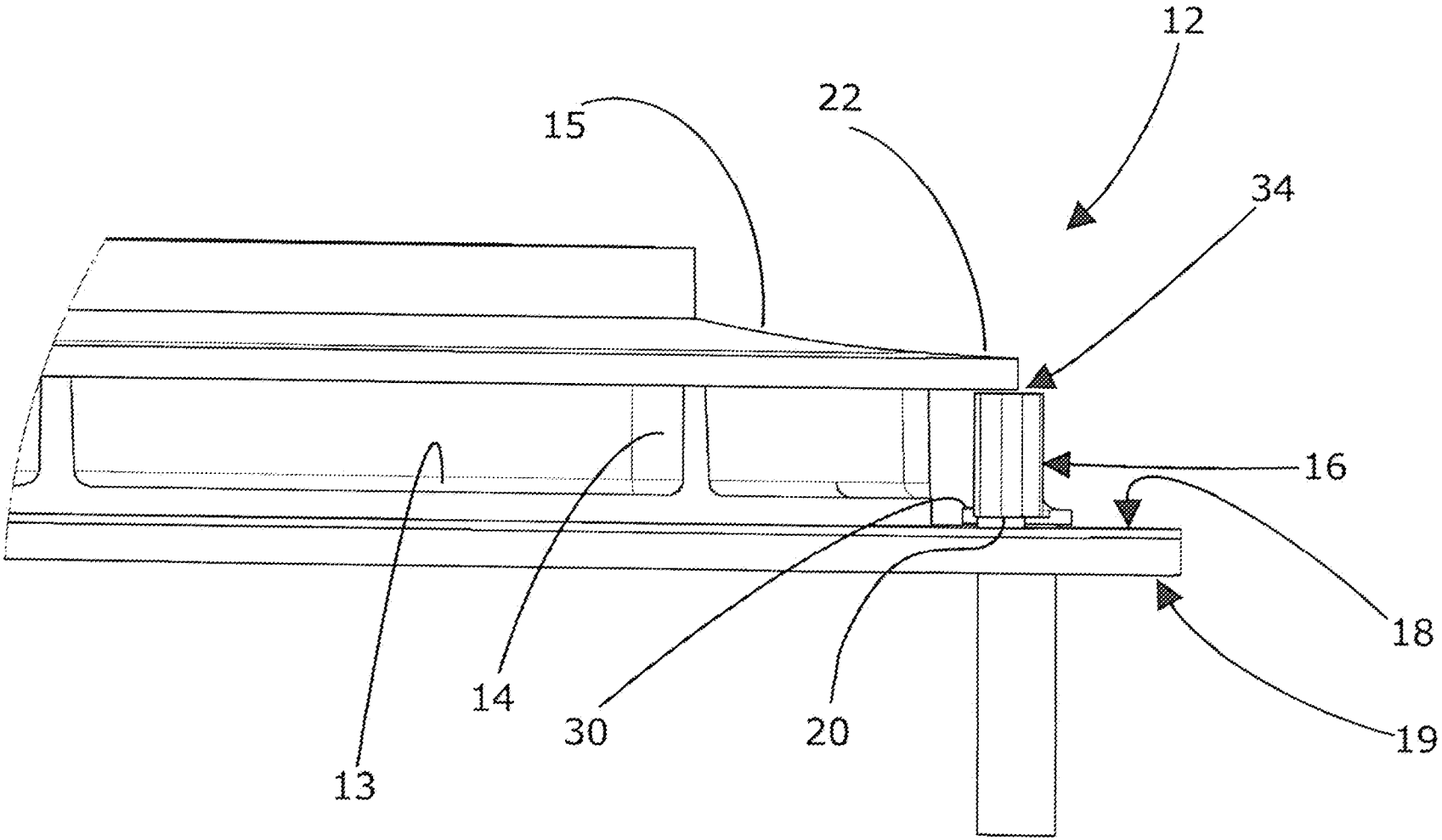
FIG. 3 shows a side view of the pumping elements of FIG. 2.

In an embodiment, the present invention provides a mechanical coolant pump for an internal combustion engine with a pump rotor wheel with rotor blades, whereby the pump rotor wheel pumps the coolant radially outwardly. The pumping performance of the pump is controlled by variable pump stator blades which are pivotably supported by a static blade holding ring at a first axial blade end. The variable pump stator blades are arranged radially outwardly of the pump rotor wheel. The pump rotor wheel is provided with a radial blocking ring which partially overlaps and covers a second axial blade end. The variable pump stator blades are blocked by the blocking ring against loosening and cannot drop-out. A pump rotor wheel with a blocking ring makes the assembly process of the pump easier because no additional blade ring must be mounted to fix the stator blades until the pump is mounted at the engine block.

In an embodiment of the present invention, the static blade holding ring can, for example, be mounted as a separate part at a main pump body. A separate installation of the blade holding ring improves the flexibility with respect to the form and material of the ring so that the ring can be made of a material different from the material of the pump main body. By using separate prefabricated parts, the form of the blade holding ring can moreover be individually designed without restrictions.

In an embodiment of the present invention, the static blade holding ring can, for example, be provided with axial pivot openings for receiving the pivot axis' of the variable pump stator blades. A pivot opening is an uncomplex technique to provide a pivot bearing which is simple to realize and therefore cost-efficient.

In an embodiment of the present invention, the second axial blade end can, for example, be provided with a flat stop face. A flat stop face provides a uniform gap height between the blocking ring and the second axial blade end in every pivotable position of the variable pump stator blade.

In an embodiment of the present invention, the flat stop face and the blocking ring can, for example, form a gap there between, whereby the height of the gap can, for example, be between 0.5 and 5 mm. The gap can, for example, be less than the axial length of the pivot axis of the variable pump stator blades so that the pivot axis cannot drop out of the axial pivot opening. The gap should have an axial height that prevents the blades from loosening, and the gap height should be as low as possible to provide that the second blade end of the blades cannot jam with the blocking ring.

In an embodiment of the present invention, the blocking ring can, for example, overlap the pivot axis of the variable pump stator blades. This provides that the blades do not loosen and jam.

In an embodiment of the present invention, the blocking ring can, for example, be an integrated part of the pump rotor wheel. This construction allows a cost-efficient production of the mechanical coolant pump because additional working steps for fixing the stator blades can be omitted.

Alternatively, the blocking ring can, for example, be formed as a separate part of the pump rotor wheel. A separate installation of the blocking ring improves the flexibility with respect to the form and material of the blocking ring so that the blocking ring can be made of a material different from the material of the pump rotor wheel, e.g. a material with a friction coefficient less than the stator blades material.

FIG. 1 shows a mechanical coolant pump 10 for an internal combustion engine. The mechanical coolant pump 10 comprises a main pump body 26 supporting a control ring 19, a static blade holding ring 18 holding variable pump stator blades 16 and a pump rotor wheel 12. The main pump body 26 is formed as a fluid-tight housing. The main pump body 26 is provided with a mounting flange 11 so that the main pump body 26 can be mounted directly to an engine block (not shown) with the flange 11 or can have a cover body (not shown) mounted to the flange 11.

The rotatable pump rotor wheel 12 which is mounted on an axial shaft 27 is provided with numerous rotor blades 14 which are positioned between a first circular plate 13 with a central inlet opening 17 and a second circular plate 15. The rotor blades 14 protrude up to the circumference of the first circular plate 13. The second circular plate 15 is provided with a circumference larger than the circumference of the first circular plate 13. The radial protrusion ring of the second circular plate 15 extending radially with respect to the circumference of the first circular plate 13 and is forming a blocking ring 22.

Radially outwardly of the pump rotor wheel 12, numerous variable pump stator blades 16 are arranged on a static blade holding ring 18. The static blade holding ring 18 can be formed as a separate part which is mounted at the main pump body 26. Alternatively, the static blade holding ring 18 can be formed as an integrated part of the main pump body 26. The static blade holding ring 18 is provided with numerous axial pivot openings 28 for receiving the pivot axis 30 of the variable pump stator blades 16. In addition, the static blade holding ring 18 is provided with axial openings 29 of a longitudinal form in which a pin connects the variable pump stator blades 16 with the control ring 19. The variable pump stator blades 16 can be pivoted if the control ring 19 is moved.

The variable pump stator blades 16 are provided with a first axial blade end 20 and a second axial blade end 24, whereby the second axial blade end 24 provides a flat stop face 32.

The variable pump stator blades 16 are pivotably supported with the first axial blade end 20 by the static blade holding ring 18. The blocking ring 22 and the second axial blade end 24 form a gap 34 there between, whereby the gap 34 has a height between 0.5 and 5 mm. The gap height must be less than the axial length of the pivot axis 30 of the variable pump stator blades 16.

The mechanical coolant pump 10 is assembled in two steps. First, the variable pump stator blades 16 are mounted with the pivot axis 30 of the first axial blade end 20 into the axial pivot openings 30. After that, the pump rotor wheel is press-fitted to the axial shaft 27 so that the blocking ring 22 partially overlaps the second axial blade end 24 of the stator blades 16 and the circumferential end of the blocking ring 22 overlaps the pivot axis 30 of the stator blades 16.

This improved design of the mechanical coolant pump 10 allows turning movements of the pump 10 during the transfer to the engine block without the danger of loosening the blades 16.

The present invention is not limited to embodiments described herein; reference should be had to the appended claims.

What is claimed is:

1. A mechanical coolant pump for an internal combustion engine, the mechanical coolant pump comprising:

a pump rotor wheel comprising a blocking ring and rotor blades, the rotor blades being configured to pump a coolant radially outwardly;

variable pump stator blades pivotably supported by a static blade holding ring at a first axial blade end, the variable pump stator blades being arranged radially outwardly of the pump rotor wheel; and a second axial blade end, wherein the blocking ring is arranged to partially overlap the second axial blade end, the variable pump stator blades include a pivot axis, and the static blade holding ring includes axial pivot openings which are configured to receive the pivot axis of the variable pump stator blades, the second axial blade end includes a flat stop face, and the blocking ring is configured to overlap the pivot axis of the variable pump stator blades.

2. The mechanical coolant pump as recited in claim 1, further comprising a main pump body, wherein the static blade holding ring is mounted as a separate part at the main pump body.

3. The mechanical coolant pump as recited in claim 1, wherein the flat stop face and the blocking ring are arranged to form a gap between the flat stop face and the blocking ring.

4. The mechanical coolant pump as recited in claim 3, wherein a height of the gap is between 0.5 and 5 mm.

5. The mechanical coolant pump as recited in claim 3, wherein a height of the gap is less than a length of the pivot axis of the variable pump stator blades.

6. The mechanical coolant pump as recited in claim 1, wherein the blocking ring is an integrated part of the pump rotor wheel.

7. The mechanical coolant pump as recited in claim 1, wherein the blocking ring is formed as a separate part of the pump rotor wheel.

* * * * *